US005894742A

United States Patent [19]

Friedt

[11] Patent Number: 5,894,742

[45] Date of Patent: Apr. 20, 1999

[54] METHODS AND SYSTEMS FOR DELIVERING AN ULTRA-PURE GAS TO A POINT OF USE

[75] Inventor: Jean-Marie Friedt, San Francisco, Calif.

[73] Assignee: L'Air Liquide, Societe Anonyme pour l'Etude et, l'Exploitation des Procedes Georges Claude, Paris, France

[21] Appl. No.: 08/931,639

[22] Filed: Sep. 16, 1997

[51] Int. Cl.[6] ..... F17C 9/02

[52] U.S. Cl. ..... 62/50.2; 62/606

[58] Field of Search ..... 62/50.2, 606

[56] References Cited

U.S. PATENT DOCUMENTS

| | | | |
|---|---|---|---|
| 3,225,552 | 12/1965 | Farkas | 62/50.2 |
| 3,241,328 | 3/1966 | Engel et al. | 62/50.2 |
| 3,552,134 | 1/1971 | Arenson | 62/50.2 |
| 4,583,372 | 4/1986 | Egan et al. . | |
| 5,359,787 | 11/1994 | Mostowy, Jr. et al. . | |
| 5,591,273 | 1/1997 | Tsukamoto et al. . | |
| 5,673,562 | 10/1997 | Friedt . | |
| 5,676,762 | 10/1997 | Kimura et al. . | |
| 5,677,480 | 10/1997 | Liyange et al. . | |

OTHER PUBLICATIONS

Wang et al.; Measurements of Droplet Formation in Withdrawing Electronics Specialty Gases from Liquefied Sources; Proceedings of 43rd Annual IES Meeting, May 1987; 6 pgs.

Chowdhury et al.; Developing a Bulk Distribution System for High–Purity Hydrogen Chloride; Micro, Sep. 1995; pp. 33–37.

*Primary Examiner*—Ronald Capossela

*Attorney, Agent, or Firm*—Jeffrey L. Wendt

[57] ABSTRACT

Methods and systems of delivering ultra-high purity gas to a point of use are claimed and described. The methods include providing a source of ultra-high purity liquid (the source preferably at a pressure and temperature sufficient to maintain the liquid in substantially the liquid phase); transporting (preferably via pressure in the source alone) the ultra-high purity liquid from the source to one or more means to effect a phase change of the ultra-high purity liquid to an ultra-high purity gas; effecting a phase change (preferably at or near equilibrium vaporization conditions) of the ultra-high purity liquid to form an ultra-high purity gas in the one or more means to effect the phase change; and routing the ultra-high purity gas from the means to effect the phase change to a point of use (preferably with no intermediate, potentially impurity-generating media between the means to effect the phase change and the point of use other than ultra-clean conduit).

17 Claims, 1 Drawing Sheet

METHODS AND SYSTEMS FOR DELIVERING AN ULTRA-PURE GAS TO A POINT OF USE

BACKGROUND OF THE INVENTION

1. Brief Description of the Invention

This invention pertains in general to the delivery of ultra-pure gases, primarily reactive gases, to a point of use. More specifically, this invention relates to methods and systems to deliver ultra-pure gases which are liquefied at room temperature with a vapor pressure above atmospheric pressure to semiconductor tools and other points of use.

2. Prior Art

Ultra-high purity (UHP) electronics specialty gases (ESG's) are needed for the integrated circuit (IC) manufacturing industry. Typical purity requirements at state of the art manufacturing are 10–100 parts per billion (ppb) for molecular impurities, less than 1 particle/$M^3$ of size greater than 0.05 micrometer, and 10–1000 parts per trillion (ppt) for metallic impurities, in accordance with the recently published SIA Roadmap.

Because of the increasing size of the wafer fabs, as well as for reasons of cost reduction, quality and safety, it is desired to increase the mass flow rate of the ESG's used on a single manufacturing site. Cost reduction has been attempted frequently in practice by reducing the number of cylinder cabinets on a site and merely increasing the flow rate extracted from ESG storage cylinders, with sometimes application of thermal energy onto the cylinders. However, this solution is of limited capability because imperfect cylinder exchange procedure is a well known practical source of contamination and of its subsequent detrimental consequences.

Moreover, in the case of ultra-pure ESG's which are liquefied at room temperature with a vapor pressure above atmospheric pressure, high mass flow rate gas delivery involves the extraction of a biphasic gas-liquid aerosol from the storage container of pressurized liquid ESG, because the energy of vaporization is difficult to compensate in practice from an external heat source.

An increased mass flow rate extraction of exclusively gas phase ESG is possible by introducing large size containers as a means of bulk storage for delivery of these ESG's, via increased thermal transfer to the pressurized ESG liquid phase due to a larger liquid-gas interface area. The limiting value of pure gas phase supply will depend mostly on flow rate and duration, depending on the specific ESG physical properties and on the container thermo-mechanical properties.

It has been proposed to solve the problem by improving the thermal energy exchange at the evaporating liquid surface and/or by trapping or volatilizing the liquid phase droplets of the aerosol. These means indeed alleviate the problem within an intermediate range of mass flow rates but become insufficient for the exceedingly high mass flow rates needed in modern installations. Also, the perfect removal of the liquid phase droplets is extremely difficult or impossible at such high flow rates.

The undesirable consequences of such biphasic mist extraction for ESG delivery are extremely severe, especially:

1. the loss of the purification phenomenon intrinsic in the evaporation of the pressurized liquid into gas phase;
2. the introduction of liquid phase into devices designed for gas flow control, which cannot function properly under such circumstances; and 3. many ESG's are practically significantly more corrosive in their liquid phase, more so if not of ultra-high purity, and above conditions frequently involve materials corrosion, with the subsequent detrimental consequences on contamination control and safety.

Therefore it would be advantageous for many industries, including the semiconductor manufacturing industry, if high purity, ultra-pure and/or ultra-high purity gases could be delivered to a point of use with avoidance of most or all of these detriments.

SUMMARY OF THE INVENTION

In accordance with the present invention, methods and systems are presented which overcome many if not al of the above-mentioned detrimental features of prior methods and systems.

One aspect of the invention is a method of delivering an ultra-high purity gas, preferably an ESG, from a first station to a second station distal from the first station (the second station preferably being a point of use in a semiconductor fab), the method comprising the steps of:

(a) providing a source (preferably a bulk source) of an ultra-high purity liquid, the ultra-high purity liquid having the characteristic of being liquefied at room temperature with a vapor pressure above atmospheric pressure;

(b) transporting (preferably via pressure in source pressure alone which is above atmospheric, although pumping means may be employed in some embodiments) the ultra-high purity liquid from the source to one or more means to effect a phase change of the ultra-high purity liquid to form an ultra-high purity gas at a pressure less than the source pressure;

(c) effecting a phase change (preferably at or near equilibrium vaporization conditions) of the ultra-high purity liquid to form an ultra-high purity gas in the one or more means to effect the phase change, the means to effect the phase change having a means to effect phase change pressure less than the source pressure but higher than the second station (preferably the means to effect phase change pressure is atmospheric pressure); and (d) routing the ultra-high purity gas from the means to effect the phase change to the second station, the second station preferably at or near a point of use (preferably with no intermediate, potential impurity-generating media between the means to effect the phase change and the second station other than ultra-clean conduit).

In preferred methods in accordance with the invention, the phase change is performed "on-demand" by the second station or point of use, and the phase change rate is preferably controlled in real time via computer control or other real-time control means. Preferably, a plurality of means to effect phase change (also sometimes referred to herein as vaporizers or evaporators) are employed, each preferably servicing a dedicated point of use, although it is also within the invention to have more than one phase change means assigned to a single point of use.

Preferably at least the transporting and phase change steps are performed in double-wall conduits and vessels.

Another aspect of the invention includes systems for delivering ultra-high purity gas, preferably an ESG, from a first station to a second station distal from the first station (the second station preferably being a point of use in a semiconductor fab), the system comprising:

(a) a container (preferably a bulk container) adapted to be filled at least partially with ultra-high purity liquid, the ultra-high purity liquid in a container having the characteristic of being liquefied at room temperature with a vapor pressure above atmospheric pressure, the container having mechanical strength to withstand a pressure and temperature sufficient to maintain the ultra-high purity liquid in substantially the liquid phase;

(b) means for transporting the ultra-high purity liquid from the container to one or more means to effect a phase change of the ultra-high purity liquid to form an ultra-high purity gas, the means for transporting having first and second ends, the first end connected to one or more containers of ultra-high purity liquid, and at the second end connected to one or more means to effect phase change;

(c) one or more means to effect phase change connected to the container via the means for transporting, each means to effect phase change comprising means sufficient to vaporize the ultra-high purity liquid (preferably at or near equilibrium vaporization conditions) to form an ultra-high purity gas in the one or more means to effect phase change; and (d) conduit (preferably ultra-clean) connecting each of the phase change devices to a station distal from the means to effect phase change, preferably a point of use (preferably with no intermediate, potentially impurity-generating media between the phase change device and the point of use other than ultra-clean conduit).

As used herein the term "ultra-high purity" means a gas or liquid having 10–100 parts per billion (ppb) molecular impurities less than 1 particle/$M^3$ of size greater than 0.05 micrometer, and 10–1000 parts per trillion (ppt) for metallic impurities, in accordance with the recently published SIA Roadmap. Of course, most preferred are ultra-high purity gases and liquids preferably having less than 10 ppb molecular impurities, and preferably less than 10 ppt metallic impurities.

The methods and systems of the invention combine the advantages of bulk supply and of clean liquid phase ESG vaporization in answering the need for increasingly high mass flow delivery rates of ultra-high purity ESG's for IC manufacturing. Further understanding of the invention may be had by reviewing the drawing and description of preferred embodiments.

DESCRIPTION OF PREFERRED EMBODIMENTS

Figure 1:
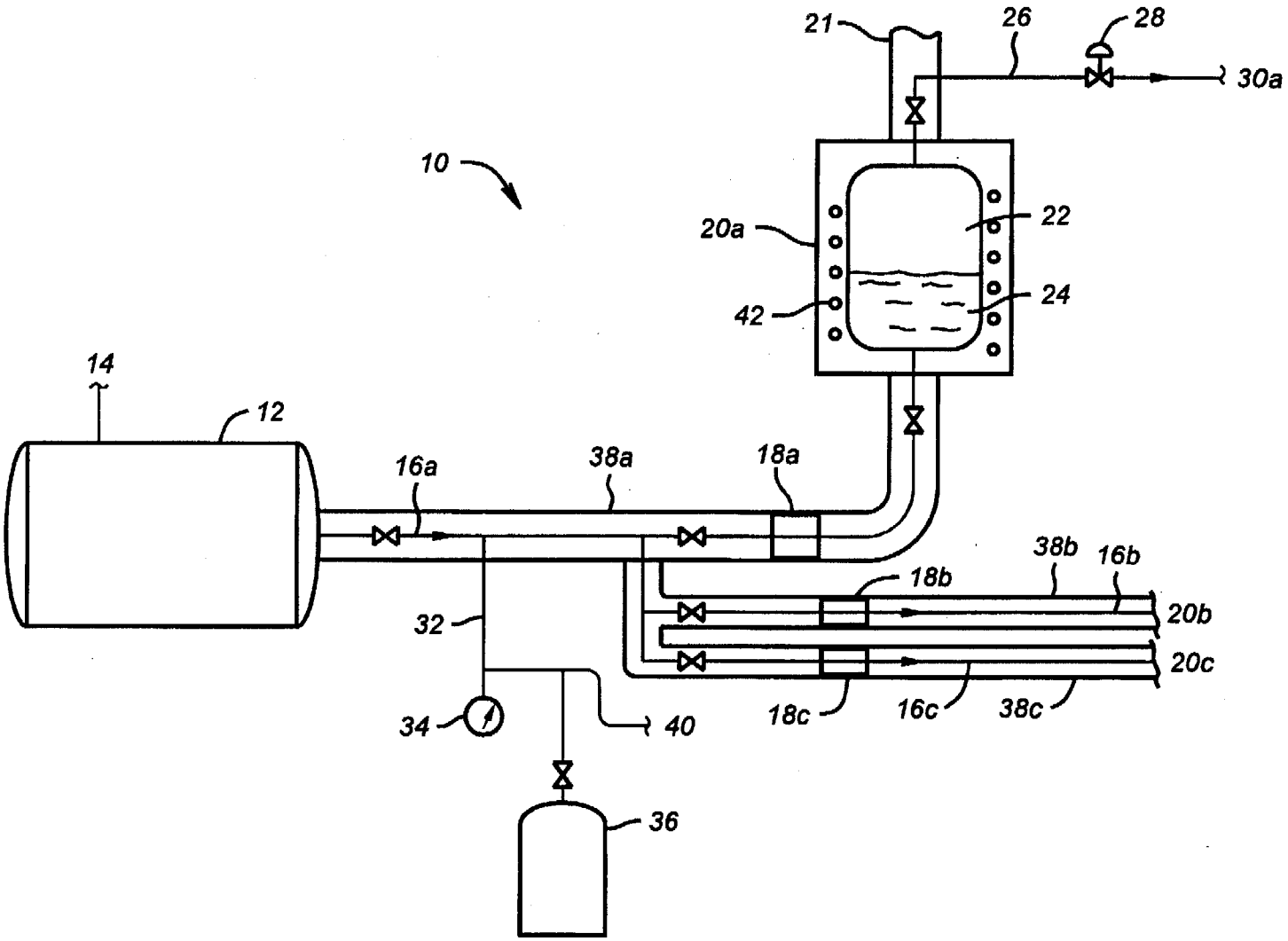
FIG. 1 is a schematic process flow diagram of a method and system in accordance with the invention.

The advantages of the methods and systems of the present invention are achieved using the following principles and preferred installations. Although the focus of the following discussion is on electronic specialty gases, such as dichlorosilane (DCS), trichlorosilane (TCS), $NH_3$, $C1_2$, HCl, HBr, HF, $N_2O$, NO, $CIF_3$., perfluorocarbon compounds (such as $CF_4$, $NF_3$, and the like), the principles of the invention may be followed and be beneficial whenever an ultra-high purity gas is desired to be delivered to a point of use. Other instances of use include the food industry, where ultra-high purity gases and liquids are frequently used in packaging foods. For simplicity herein, the second station referred to in the Summary of the Invention is simply referred to as the "point of use", it being understood that in certain embodiments there may exist equipment (for example valves, flow meters, buffer vessels, holding vessels) downstream of the vaporizer, before the actual point of use, these method and system embodiments being deemed to be within the present invention, to the extent that the intermediate equipment does not contribute impurities sufficient to make the ultra-high purity gas unacceptable to the end user. In other words some minimal de minimus amount of impurity generation may be acceptable.

Referring now to FIG. 1, a system 10 in accordance with the invention is depicted in schematic process flow diagram format. A bulk pressurized-liquid phase ESG container 12 contains ultra-high purity liquid ESG having the purity attributes previously defined, obtained, for example, from a purification plant. Gas pressure is applied to container 12 through a conduit 14, the pressure preferably being precisely regulated. The gas supplied through conduit 14 is preferably inert and may be selected from any gas that is sufficiently inert to the material of container 12, conduit 14 and liquid ESG in container 12. Gas supplied through conduit 14 may be, for example helium, argon, nitrogen, krypton, zenon, neon, or mixtures of two or more of these. Particularly preferred is ultra-high purity helium.

Container 12 is designed to maintain the necessary pressures and temperatures required to maintain a variety of ESGs in liquid form. Container 12 is preferably made of material and with an internal surface finishing appropriate to be inert to the ultra-high purity liquid ESG. Typically and preferably 316 L stainless steel which is electropolished and/or coated by an electroless deposited nickel film, or Hastelloy, Monel, nickel or other similar corrosion resistant materials are preferably employed. In addition, preferably the surfaces exposed or to be exposed to the ultra-high purity liquid and gaseous ESG are treated in accordance with assignee's treatment procedures detailed in assignee's issued U.S. Pat. Nos. 5,591,273 and 5,676,762, which are incorporated by reference herein in their entirety.

The ultra-high purity ESG is transported, preferably at high mass flow rate preferably ranging from about 0.1 standard liter per minute (slm) to about 10,000_slm, more preferably ranging from about 1 slm to about 100 slm, in substantially its liquid phase from container 12, through transport means **16*a*, 16*b*, 16*c*, . . . 16*n*, to one or more means to effect phase change 20*a*, 20*b*, 20*c*, . . . 20*n* (only one illustrated in FIG. 1). The actual flow rates will depend on the demands of the point of use, as explained further herein. Means to effect phase change 20 are preferably located close to the point of use of the ultra-high purity ESG in gas phase. Liquid mass flow controllers 18*a*, 18*b*, 18*c*. . . . 18*n* control the flow of the substantially liquid ESG to the phase change means. Each means to effect phase change 20 has a space 22 into which the ultra-high purity, substantially liquid ESG 24 is evaporated, preferably at or near room temperature (about 25° C.). The gaseous ESG then flows through appropriately inerted conduit 26 toward the point of use. Downstream of each evaporator 20, the ESG gas pressure is reduced to the desired working pressure at the point of use 30 (or to a slightly higher pressure, for example if there exists a buffer vessel between phase change means 20 and the point of use 30) using a pressure regulator 28. Gas mass flow rate of ESG to the processing tools or other points of use 30** is controlled by conventional mass flow controllers (not illustrated).

All parts of components 16, 18, 20, 26, and 28 that may come in contact with the ESG are made of corrosion resistant materials which present inert surfaces against the specific ESG. Materials and procedures for ensuring that the surfaces exposed to the ESG are inert are identical to those described above for container 12.

Since the specific mass of the liquefied ultra-high purity ESG is typically 100 times higher than that of the gaseous ultra-high purity ESG, mass flow-control instrumentation is significantly easier to design and construct with the required corrosion resistance properties and precision for a liquid phase distribution system than for the corresponding gas phase distribution system.

As close as possible to the point of use 30 of the gaseous ESG, respecting the local rules of safety and of limitations in stored-quantities of dangerous products, the bulk liquid ESG flow is preferably divided into a plurality of branches conducting to a series of phase change devices, represented in FIG. 1 by 20*a*, 20*b*, and 20*c* (commonly referred to as evaporators), in which the pressurized-liquid phase ESG is converted into gas phase. Preferably this is performed at or near practical equilibrium vaporization conditions; in other words the thermal energy transfer from the external environment to the liquid ESG essentially equals the energy of vaporization. The practical limiting conditions are independently established experimentally for each chemical compound by checking the absence of emission of an aerosol from the evaporator.

The specific number of evaporators (20*n*) needed for a specific installation is decided on the basis of the ESG gas flow needed for points of use 30 used in the manufacturing process and from the preferred criterion of "equilibrium vaporization", which dictates a practical upper limit for the gas mass flow rate-gas usage cycle time under which monophasic gas phase ESG is extracted. The volume of the liquid phase storage in container 12 (which may in fact be two or more containers, for example when a spare or redundant container is employed) is dictated by a compromise between the mass consumption rate at the point of use 30 and safety considerations, knowing that bulk container storage exchange will be minimized for both safety, cost and contamination control considerations.

Liquid phase ultra-high purity ESG is flowed into each means to effect phase change 20 at a mass flow rate that is sufficient that liquid phase and gas phase always coexist in means to effect phase change 20. For this purpose a slight inert gas pressure (preferably ultra-high purity helium) is applied in container 12, as described previously.

Although in a single manufacturing installation, the whole system 10 can operate based on pressure difference driven flows and manual setting of the pressure and flow control equipment, in practice, the gas flow cycles needed for the several tools may vary widely. It is then preferable to install a computer control of the liquid flow rate feeding each phase change means 20, based on the pressure measurement in each of these and on the precise gas pressure and mass flow rate downstream of pressure regulator 28, as well as based on measurement of the level of liquid in each vaporizer 20.

Completing the systems of the invention illustrated in FIG. 1, typically and preferably the systems of the invention include conventional vacuum purge apparatus 32, 34, 36, and 40, wherein 32 represents ultra-clean conduit, 34 represents a pressure monitor, 36 represents an inert gas source, and 40 represents a vacuum source. All of these components and methods of their use are well known in the semiconductor art and require no further explanation to the ordinary skilled artisan.

Since liquid phase ultra-high purity ESG delivery systems of the invention operate under pressures sufficient to maintain the ESG in substantially the liquid phase until evaporated, in order to avoid any risk of the consequences of a possible leak, the whole piping is constructed from double wall piping 38*a*, 38*b*, 38*c* equipped with appropriate safety sensors commonly known in the art and needing no further explanation to the ordinary skilled artisan. Similarly, phase change means 20*a*, 20*b*, 20*c*, . . . 20*n* are preferably installed in cabinets allowing for emergency evacuation of the gases through conduits 21 in case of leak. In the case of accidental ESG leakage, valves (preferably pneumatic) isolate the distribution system at several places in order to stop the ESG flows, while the leaked gases are collected in an emergency abatement system in order to protect the environment from any accidental pollution.

Depending on the specific configuration of the particular systems of the invention and of their usage, the phase change means 20 may be equipped with devices represented by 42 in FIG. 1 providing extra energy to the pressurized liquefied ESG to be vaporized, for example via gas convection heating using a non-reactive gas such as nitrogen or helium, or electrical Joule heating, whose power is preferably computer controlled based on the pressure or/and temperature measurement of the gas evaporated in each phase change means 20.

The ESG's to which the concepts of the invention apply include those typically needed to be delivered in a wafer fab at increasingly high flow rate and to be used at ultra-high purity and which are liquid under pressure of less than 100 bar, preferable less than 15 bar.

Optionally, when phase change means 20 is operating at the upper limit of "equilibrium conditions", pressure regulator 28 can be heated to compensate for the possible cooling by Joule-Thompson expansion, or double stage pressure reducers can be installed.

Purification and filtration devices can be installed optionally either on one or both of the liquid ESG and the gas ESG flows.

Before transfilling the liquid ESG into container 12, container 12 is typically and preferably purged, especially to remove any adsorbed moisture, using preferably a thermally activated degassing under vacuum or under inert ultra-high purity gas at a temperature of at least 80° C. or a chemical drying agent using gaseous or liquid phase dimethyl propane (DMP) or other advanced chemical drying agents developed separately in U.S. Pat. Nos. 5,591,273 and 5,676,762, previously incorporated herein by reference.

EXAMPLE

The principles of the invention are illustrated in the following example, which is not intended to be limiting of the claims.

High flow rate delivery of ultra-high purity $NH_3$ gas

High consumption of ultra-high purity $NH_3$ is needed at some semiconductor manufacturing sites, with typical gas flow rates exceeding 100 slm, to be delivered to several installations consuming each typically 1 slm.

This may be achieved in accordance with the principals of the present invention by installing in a yard a bulk container of pressurized liquefied $NH_3$, of a volume comprised between 1000 and 10,000 standard liters, under a pressure of approximately 10 bar, adapted to deliver about $10^6$ to $10^7$ standard liters of ultra-high purity gas. This container is of course installed following current safety regulations, including emergency containment and abatement of any accidental leakage. The container is made of metal, with a high surface finish, selected for negligible corrosion and absence of particle release. Prior to transfer of liquid NH3 into this container, it is carefully washed and dried at a temperature higher than ambient, typically from about 80 to about 120°

C., preferably assisted by chemical drying in order to avoid any residual molecular adsorption, especially adsorption of $H_2O$.

The pressurized liquefied $NH_3$ is sampled from the bulk container via a plunging tube and transported from the yard close to the point of consumption through a double wall stainless steel tubing designed and treated similarly to the bulk container for its mechanical and internal surface properties. The liquid flow is typically 0.1 liter per minute, which is easily controlled by commercially available equipment.

A gas detector is installed to detect any accidental leakage from the inner tubing into the containment space and controls a safety valve at the bulk container exit.

Close to the point of use, the liquefied pressurized $NH_3$ flow is divided into several branches, leading to a set of evaporators. In this example, these re simply conventional 10 to 50 liter gas cylinders, equipped with an additional connection at their bottom. They are installed in conventional cylinder cabinets for safety. The cylinders are fed by pressurized liquefied $NH_3$ at the bottom of the cylinders; gaseous $NH_3$ evaporates from these cylinders and is handled after the cylinder exit for pressure, flow rate and safety control similar to the procedures used in a conventional gas distribution system. In order to ensure ultra-high purity and singe phase gas emission from the evaporateors, the emitted gas flow rate is restricted to below a typical value of 5 slm (in the case of $NH_3$). The distribution of the pressurized liquefied NH3 from the bulk container down to the evaporators is actuated by an overpreessure of a few bars of nitrogen, in this example applied onto container 12. Flow can be interrupted at several critical places in case of emergency.

The flow into the evaporators is reguulated using liquid mass flow controlers installed on the individual branch conduits; they are controlled by sensors of the liquid level= in the cylinders, such that the level of the liquefied gas in them is substantially constant and filled to about 70 percent of their total capacity, indepedent of the gas consumption downstream fro the manufacturing process. The total connsumption of the chemical gas is recorded precisely, such as to switch the prouct source to to a spare bulk container well before the original one is empty; typically, the container is exchanged when approximately 90 percent of its content has been used.

Occasionally, the whole system, including the bulk container, the distribution conduits and the evaporators is totally emptied of its liquid content, which in such case is not used in the plant manufacturing process, and carefully cleaned and purged, before being refilled with fresh product. The purpose of this periodical maintenance is to discard from the system the growingly impure liquid phase chemical.

In practice, the container is sized such that the container allows continuous supply of product for a typical period of 6 months. At the considered product flow rate, high gas quality delivery using the conventional supply method in cylindeers (of about 50 liter volume) would necessitate installation of a large number of cylinder cabinets on site and frequent cylinder exchange, typically several times per da. Usage of bulk cylinders for direct gasd distribution partially alleviates the problem, but still necessitates installation of multiple containers at the considered range of flow rates when ultra-high purity snghle phase gas product is required for the distribution.

Summarizing, the developed system has been found to be able to deliver ultra-high purity product, with highly reduced frequency of product container exchange or refilling, hence allowing very tangible advantages in terms of product reliability, safety, quality and cost.

Thus with the systems and methods of the present invention, avoidance of one of the current major problem in the distribution of ultra-high purity ESG's at high flow rates, i.e. the extraction of a biphasic gas-liquid aerosol from the storage container of pressurized liquid ESG, may be achieved via liquid phase-pressurized distribution from storage yard to a point close to point of use, subsequent division into liquid flow rates compatible with equilibrium, clean evaporation of the ESG on site.

The present invention has been described in detail with respect to certain preferred embodiments. However, as is understood by those skilled in the art, variations and modifications can be made without any departure from the scope of the present invention as defined by the following claims.

What is claimed is:

1. A method of delivering an ultra-high purity gas from a first station to a second station distal from the first station, the method comprising the steps of:

(a) providing a source of an ultra-high purity liquid, the ultra-high purity liquid having a characteristic of being liquefied at room temperature with a vapor pressure above atmospheric pressure, the source having a source pressure;

(b) transporting the ultra-high purity liquid from the source to one or more means to effect a phase change of the ultra-high purity liquid to form an ultra-high purity gas at a pressure less than the source pressure;

(c) effecting a phase change of the ultra-high purity liquid to form an ultra-high purity gas in the one or more means to effect the phase change, the means to effect the phase change having a means to effect phase change pressure less than the source pressure but higher than a pressure of the second station; and (d) routing the ultra-high purity gas from the means to effect the phase change to the second station, the second station preferably at or near a point of use.

2. Method in accordance with claim 1 wherein the source is at a pressure and temperature sufficient to maintain the liquid in substantially the liquid phase.

3. Method in accordance with claim 1 wherein the source is a bulk source.

4. Method in accordance with claim 1 wherein the transporting step is achieved by pumping with a pump.

5. Method in accordance with claim 1 wherein the transporting step is achieved only by pressure in said source.

6. Method in accordance with claim 1 wherein the step of effecting the phase change is achieved by heating the ultra-high purity liquid.

7. Method in accordance with claim 1 wherein the step of effecting a phase change is performed on demand of the point of use.

8. Method in accordance with claim 1 wherein the ultra-high purity liquid is transported to a plurality of said means to effect a phase change, each of said means to effect said phase change serving a corresponding point of use.

9. Method in accordance with claim 1 wherein the transporting step and the effecting phase change step are performed in double-walled containment means.

10. Method in accordance with claim 1 wherein the step of effecting the phase change in said means for effecting phase change is accomplished via electric heating of the phase change means.

11. Method in accordance with claim 1 wherein the means for effecting the phase change is operated so that the ultra pure liquid changes from liquid phase to gas phase at or near equilibrium conditions.

12. A system for delivering ultra-high purity gas from a first station to a second station distal from the first station, the system comprising:

(a) a container adapted to be filled at least partially with ultra-high purity liquid, the ultra-high purity liquid having the characteristic of being liquefied at room temperature with a vapor pressure above atmospheric pressure, the container having mechanical strength to withstand a pressure and temperature sufficient to maintain the ultra-high purity liquid in substantially the liquid phase;

(b) means for transporting the ultra-high purity liquid from the container to one or more means to effect a phase change of the ultra-high purity liquid to form an ultra-high purity gas, the means for transporting having first and second ends, the first end connected to one or more containers of ultra-high purity liquid, and at the second end connected to one or more means to effect phase change;

(c) one or more means to effect phase change connected to the container via the means for transporting, each means to effect phase change comprising means sufficient to vaporize the ultra-high purity liquid to form an ultra-high purity gas in the one or more means to effect phase change; and (d) conduit connecting each of the phase change devices to a station distal from the means to effect phase change.

13. System in accordance with claim 12 wherein the means to effect a phase change of the ultra-pure liquid is equipped with means to effect said phase change at or near equilibrium conditions.

14. System in accordance with claim 12 wherein the container serves and is connected to a plurality of means to effect phase change of said ultra-high purity liquid to form said ultra-high purity gas, via a plurality of said means for transporting.

15. System in accordance with claim 12 which further includes a pressure regulator downstream of said means to effect phase change to control pressure of ultra-high purity gas flowing to the point of use.

16. System in accordance with claim 12 wherein the means to effect phase change are enclosed in a cabinet.

17. System in accordance with claim 12 wherein the means for transporting and the means for effecting phase change are double-walled construction.

* * * * *

UNITED STATES PATENT AND TRADEMARK OFFICE

CERTIFICATE OF CORRECTION

PATENT NO : 5,894,742

DATED : APR. 20, 1999

INVENTOR(S) : JEAN-MARIE FRIEDT

It is certified that error appears in the above-identified patent and that said Letters Patent is hereby corrected as shown below:

On the title page,

JEAN-MICHEL CHARLES is added as a co-inventor.

Signed and Sealed this

Ninth Day of May, 2000

*Attest:*

*Attesting Officer*

Q. TODD DICKINSON

*Director of Patents and Trademarks*